United States Patent [19]

Burk

[11] 4,419,055

[45] Dec. 6, 1983

[54] LOW PRESSURE FLUID SUPPLY SYSTEM

[75] Inventor: Ronnie F. Burk, Waterloo, Iowa

[73] Assignee: Deere & Company, Moline, Ill.

[21] Appl. No.: 191,659

[22] Filed: Sep. 26, 1980

[51] Int. Cl.[3] ..... F04B 17/00

[52] U.S. Cl. ..... 417/396; 91/291

[58] Field of Search ..... 417/396, 403, 404; 91/291, 292

[56] References Cited

U.S. PATENT DOCUMENTS

| | | | |
|---|---|---|---|
| 2,069,123 | 1/1937 | Weaver . | |
| 2,579,670 | 12/1951 | Hjarpe | 91/291 X |
| 2,920,640 | 1/1960 | Porter | 417/404 |
| 3,016,016 | 1/1962 | Horlacher | 417/396 |
| 3,552,269 | 1/1971 | Arndt | 91/291 |

*Primary Examiner*—Leonard E. Smith

[57] ABSTRACT

A fluid supply system includes a pump body having a main bore connectible through inlet check valves to draw fluid from a fluid reservoir and through outlet check valves to supply low pressure fluid to a low pressure function upon reciprocation of a free piston in the main bore. The free piston includes a pair of coaxial driving pistons on either side which extend into main passages which are alternately connected to a high pressure source to cause reciprocation of the free piston. A first spool valve which responds to the completion of a free piston stroke activates a second spool valve which changes the high pressure source connections to the driving pistons.

2 Claims, 1 Drawing Figure

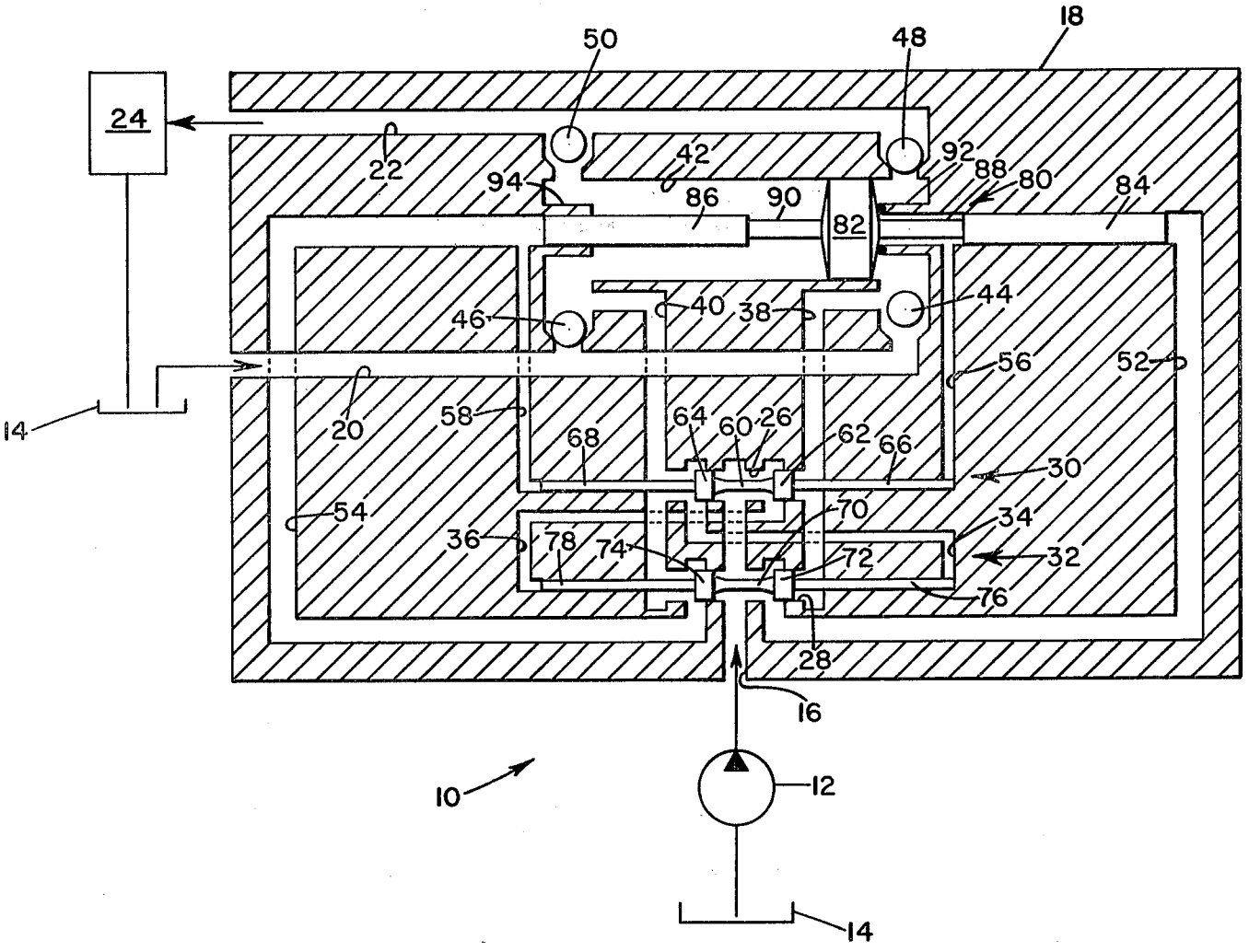
18
84
52
80
88
92
48
82
90
42
86
50
94
22
24
14
44
56
38
40
46
20
58
30
32
34
76
66
62
70
72
28
26
60
64
68
74
78
36
54
16
12
14
10

LOW PRESSURE FLUID SUPPLY SYSTEM

BACKGROUND OF THE INVENTION

The present invention relates generally to low pressure hydraulic pumps and more particularly to a hydraulically driven, pressure compensated, self-priming, low-pressure hydraulic pump.

In the past, complex and expensive pumps were required to obtain pressure compensated, self-priming, low pressure operation and attempts to make direct pressure-operated reciprocating piston pumps were frustrated by the incompressibility of hydraulic fluid which would present totally bi-stable operation of the free piston.

SUMMARY OF THE INVENTION

The present invention provides a simple, hydraulically driven, pressure compensated, self-priming, low pressure supply system.

The above and additional advantages of the present invention will become apparent to those skilled in the art from a reading of the following detailed description when taken in conjunction with the accompanying drawing.

BRIEF DESCRIPTION OF THE DRAWING

The drawing is a schematic, partially in section, incorporating the preferred embodiment of the present invention.

DESCRIPTION OF THE PREFERRED EMBODIMENT

Referring now to the drawing, therein is shown a low pressure fluid supply system 10 including a high pressure pump 12 drawing fluid from a fluid reservoir 14 and supplying it to a high pressure inlet 16 in a low pressure pump body 18.

The pump body 18 further contains a reservoir passage 20 which is connected so as to allow the drawing of fluid from the fluid reservoir 14 and low pressure passage 22 which is connected so as to allow the supplying of low pressure fluid to a conventional low-pressure function, generally designated 24, which could be a hydraulic cylinder or hydraulic motor.

Referring back to the high pressure inlet 16 and utilizing a convention wherein the right and left hand sides of the pump body 18 are respectively on the right and left hand sides of the viewer, the high pressure inlet 16 is medially connected to first and second bores 26 and 28 which are positioned in first and second five-way valves 30 and 32, respectively.

The first bore 26 has ports immediately adjacent to the right and left of the high pressure inlet 16 which are respectively connected to right and left pilot passages 34 and 36 and which, in turn, are directly connected to the left and right ends, respectively, of the second bore 28. Right and left relief passages 38 and 40 are respectively conncted to the right and left ends of the first bore 26 as well as the right and left ends respectively of the second bore 28.

The right and left relief passages 38 and 40 are connected to a cylindrical main bore 42 in the pump body 18 respectively, proximate right and left inlet check valves 44 and 46 which allow the flow of fluid from the reservoir 14 via the reservoir passage 20 into the main bore 42. The right and left inlet check valves 44 and 46 are respectively adjacent to right and left outlet check valves 48 and 50 which allow the passage of fluid from the main bore 42 into the low pressure passage 22.

Coaxially aligned with the main bore 42 are portions of right and left main passages 52 and 54 which are connected to the second bore 28 respectively to the right and left of the high pressure inlet 16.

Further connected to the right and left main passages 52 and 54 are right and left control passages 56 and 58 which are connected to the right and left ends respectively of the first bore 26.

The first valve 30 includes a first spool 60 which has right and left lands 62 and 64 and right and left pilot pistons 66 and 68 which are slidable in coaxial portions of the right and left control passages 56 and 58, respectively. The first spool 60 is shiftable from a right position (as shown), in which the high pressure inlet 16 is connected to the left pilot passage 36 and the left relief passage 40 is connected to the right pilot passage 34, to a second position in which the first spool 60 connects the high pressure inlet 16 to the right pilot passage 34 and the right relief passage 38 to the right pilot passage 36.

The second valve 32 includes a second spool 70 which has right and left lands 72 and 74 and right and left pilot pistons 76 and 78 which extend into coaxial portions of the right and left pilot passages 34 and 36, respectively. The second spool 70 is movable between a right position (as shown), in which the high pressure inlet 16 is connected to the right main passage 52 and the left relief passage 40 is connected to the left main passage 54, to a left position in which the high pressure inlet 16 is connected to the left main passage 54 and the right relief passage 38 is connected to the right main passage 52.

The main bore 42 is part of a low pressure pump 80 which includes a free piston 82 which is sealingly slidable in the main bore 42. The free piston 82 includes right and left driving pistons 84 and 86 which extend into the coaxial portions of the right and left main passages 52 and 54, respectively. Adjacent the free piston 82 are reliefs 88 and 90. The free piston 82 is movable from a right position where it is near a stop 92 to a left position where it is near a stop 94. While reciprocating, the free piston 82 should never actually strike the stops 92 and 94.

Operation

In operation, the low pressure system 10 may be started at any position of the free piston 82 upon application of pressurized fluid from the high pressure pump 12 to the high pressure inlet 16 because the first and second valves 30 and 32 ensure bi-stable operation.

Starting from the position shown in the drawing, pressurized fluid in the high pressure inlet 16 is supplied to the left pilot passage 36 by the first valve 30 which causes the second valve 32 to cause pressuized fluid from the high pressure inlet 16 to pressurize the right main passage 52. Pressurization of the right main passage 52 causes the right driving piston 84 to start moving the free piston 82 to the left.

Leftward movement of the free piston 82 causes the left inlet check valve 44 to open to draw fluid into the main bore 42. Simultaneously, the outlet check valve 50 is opened to allow fluid in the main bore 42 to exit at low pressure to the low pressure function 24. As would be evident to those skilled in the art, with proper sealing between the free piston 82 and the main bore 42, the low pressure pump 80 will be self-priming.

With the free piston 82 moving to the left, it will be noted in this position that the left control passage 58, the left main passage 54, and the right pilot passage 34 are all connected to the left relief passage 40 and thence to a portion of the main bore 42 in fluid communication with the low pressure function 24. This configuration adds fluid pumped by the left driving piston 86 to that pumped by the free piston 82. Also, it will be seen that the right control passage 56 is connected by the relief 88 to that portion of the main bore 42 which is fluidly connected to the reservoir 14. This configuration maintains the spool 60 in its right position.

As the free piston 82 continues to the left, the right driving piston 84 will allow fluid communication between the pressurized right main passage 52 and the right control passage 56. However, since the left driving piston 86 will block the left control passage 58, movement of the first spool 60 will be prevented and subsequently movement of the second spool 70 will also be prevented.

When the free piston 82 approaches the second stop 94, the left control passage 58 will be placed in fluid communication with the low pressure function 24 via the relief 90. At this point, the pressurized fluid in the right control passage 56 acting on the right pilot piston 66 will cause the first spool 60 to shift to its left position while the free piston 82 approaches but never contacts the second stop 94. When the first valve 30 reaches the left position, pressurized fluid from the high pressure inlet 16 is supplied to the right pilot passage 34 to cause a shift of the second spool 70 to its left position also.

It should be noted that the first and second valves 30 and 32 when reciprocating provide fluid to the portion of the main bore 42 which is connected to the low pressure function 24 so that the displacement of the first and second valves 30 and 32 is added to the low pressure fluid due to the free piston 82. It should also be noted that the reliefs 88 and 90 can be changed in size so that the low pressure system 10 could operate when the features described in the preceding two paragraphs were reversed or simultaneous.

As would be evident to those skilled in the art, with the free piston 82, and the first and second valves 30 and 32 in their left positions, the second half of a cycle similar to the above described first part of the cycle begins. Fluid is drawn through the left inlet check valve 46 from the reservoir 14 and pumped from the main bore 42 through the outlet check valve 48 to the low pressure function 24.

It should be noted that with a constant supply pressure at the inlet 16, the above low pressure fluid system 10 would, by nature, be pressure compensated. The free piston 82 and the right and left driving pistons 84 and 86 would have forces acting in opposition and the resulting forces would accelerate the mass of these pistons thus increasing the output of the pump when the pressure drops. The mass of the system would come to equilibrium at some pressure that produced a zero resultant force. As would be evident to those skilled in the art, flow restriction losses inside the system 10, itself, would form part of the pressure load on the free piston 82 and there would be a limiting available acceleration force corresponding to zero pressure at the low pressure passage 22. Naturally, the low pressure system 10 should be designed such that acceleration of the pistons take a small portion of the cycle. This can be accomplished by increasing the displacement of the free piston 82, reducing the mass of the pistons and spools, and minimizing flow restrictions.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications, and variations which fall within the spirit and scope of the appended claims.

I claim:

1. A low pressure fluid supply system connectible to a high pressure fluid source, to a low pressure function and to a non-pressurized fluid reservoir, said low pressure fluid supply system comprising:

(a) a pump body;

(b) a main bore enclosed within said pump body having a first and a second end;

(c) first and second bores enclosed within said pump body having respective first and second ends;

(d) a high pressure inlet into said pump body connecting said high pressure fluid source to said first and second bores between said respective first and second ends thereof;

(e) first and second pilot passages enclosed within said pump body respectively connecting said first bore proximate said first end to said second end of said second bore, and connecting said first bore proximate said second end to said first end of said second bore;

(f) first and second main passages enclosed within said pump body respectively connecting said second bore proximate said first end to said first end of said main bore, and connecting said second bore proximate said second end to said second end of said main bore;

(g) first and second control passages enclosed within said pump body respectively connecting said first and second ends of said first bore to said first and second main passages approximately at said ends of said main bore;

(h) first and second relief passages enclosed within said pump body respectively connecting said first end of said main bore to said first ends of both said first and second bores, and connecting said second end of said main bore to said second ends of both said first and second bore;

(i) a reservoir passage enclosed within said pump body connecting said non-pressurized fluid reservoir to both said first and second ends of said main bore;

(j) a low pressure passage enclosed within said pump body connecting said low pressure function to both said first and second ends of said main bore;

(k) first and second check valve means respectively disposed in said first and second ends of said main bore for preventing fluid from flowing from said main bore into said reservoir passage;

(l) third and fourth check valve means respectively disposed in said first and second ends of said main bore for preventing fluid from flowing from said low pressure passage into said main bore;

(m) first spool means positioned within said first bore and extending into both said first and second control passages, said first spool means movably responsive to high pressure fluid in said first control passage thereby connecting said high pressure fluid source to said first pilot passage and connecting said first relief passage to said second pilot passage; and movably responsive to high pressure fluid in said second control passage thereby connecting said high pressure fluid source to said second pilot passage and connecting said second relief passage to said first pilot passage;

(n) second spool means positioned within said second bore and extending into both said first and second pilot passages, said second spool means movably responsive to high pressure fluid in said first pilot passage thereby connecting said high pressure fluid source to said first main passage and connecting said second relief passage to said second main passage, and movably responsive to high pressure fluid in said second pilot passage thereby connecting said high pressure fluid source to said second main passage and connecting said first relief passage to said first main passage; and (o) free piston means positioned within said main bore and extending in said first and second main passages, said free piston means for responding to high pressure fluid in said first main passage to move from a first position connecting said first control passage to said non-pressurized fluid reservoir and said second main passage to said low pressure fluid function through a series of positions for drawing fluid from said non-pressurized fluid reservoir through said first check valve means into said main bore and for urging fluid out of said main bore through said fourth check valve means to said low pressure fluid function while respectively blocking said first and second control passages from said non-pressurized fluid reservoir and said low pressure fluid function to a second position connecting said first control passage to said high pressure fluid source and said second main passage to said low pressure fluid function, said free piston means responsive to high pressure fluid in said second main passage to move from said second position through a series of positions to said first position thereby drawing fluid from said non-pressurized fluid reservoir through said second check valve means into said main bore and for urging fluid out of said main bore through said third check valve means to said low pressure fluid function.

2. A low pressure fluid supply system connectible to a high pressure pump, a fluid reservoir, and a low pressure function, said low pressure fluid supply system comprising:

(a) a pump body;

(b) a main bore enclosed within said pump body having a first and a second end;

(c) first and second bores enclosed within said pump body having respective first and second ends;

(d) a high pressure inlet in said pump body connecting said high pressure pump to said first and second bores medially between said respective first and second ends thereof;

(e) first and second pilot passages enclosed within said pump body respectively connecting said first bore proximate said first end to said second end of said second bore, and connecting said first bore proximate said second end to said first end of said second bore;

(f) first and second main passages enclosed within said pump body respectively connecting said second bore proximate said first end to said first end of said main bore, and connecting said second bore proximate said second end to said second end of said main bore;

(g) first and second control passages enclosed within said pump body respectively connecting said first and second ends of said first bore to said first and second main passages approximately at said ends of said main bore;

(h) first and second relief passages enclosed within said pump body respectively connecting said first end of said main bore to said first ends of both said first and second bores, and connecting said second end of said main bore to said second ends of both said first and second bores;

(i) a reservoir passage enclosed within said pump body connecting said fluid reservoir to both said first and second ends of said main bore;

(j) a low pressure passage partially enclosed within said pump body connecting said low pressure function to both said first and second ends of said main bore;

(k) first and second check valves respectively disposed in said first and second ends of said main bore to prevent fluid from flowing from said main bore into said reservoir passage;

(l) third and fourth check valves respectively disposed in said first and second ends of said main bore to prevent fluid from flowing from said low pressure passage into said cylindrical main bore;

(m) a first spool slidably disposed in said first bore and having first and second ends, said first spool having first and second pilot pistons respectively extending from said first and second ends and respectively extending into said first and second control passages to move said first spool to a first position when said first and second control passages are respectively connected to said high pressure pump and said main bore, and to a second position when said first and second control passages are respectively connected to said main bore and to said high pressure pump, said first spool having land means for respectively connecting said first and second pilot passages to said high pressure inlet and to said first relief passage in said first position and respectively connecting said first and second pilot passages to said second relief passage and to said high pressure inlet in said second position;

(n) a second spool slidably disposed in said second bore and having first and second ends, said second spool having first and second pilot pistons respectively extending from said first and second ends and respectively extending into said first and second pilot passages to move said second spool to a first position when said first and second pilot passages are respectively connected to said main bore and to said high pressure pump, and to a second position when said first and second pilot passages are respectively connected to said high pressure pump and to said main bore, said second spool having land means for respectively connecting said first and second main passages to said high pressure inlet and to said second relief passage in said first position and respectively connecting said first and second main passages to said first relief passage and to said high pressure inlet in said second position; and (o) a free piston slidably disposed in said main bore and having first and second ends, said free piston including first and second driving pistons respectively extending from said first and second ends and respectively extending into said first and second main passages to move said free piston to a first position when said first and second main passages are respectively connected to said high pressure pump and to said main bore, and to a second position when said first and second main passages are respectively connected to said main bore and to said high pressure pump, said free piston connecting said second main passage and said second control passage in said first position and connecting said first main passage and said first control passage in said second position while blocking the connections between said first and second positions, said free piston having relief means provided therein for connecting said first control passage to said main bore in said first position and said second control passage to said main bore in said second position.

* * * * *